US006431652B1

(12) United States Patent
Kennedy

(10) Patent No.: US 6,431,652 B1
(45) Date of Patent: Aug. 13, 2002

(54) SEAT BELT RESTRAINT LOCK FOR CHILDREN

(76) Inventor: Robert Kennedy, R.R. 1, Box 277, Emlenton, PA (US) 16373

( * ) Notice: Subject to any disclaimer, the term of this patent is extended or adjusted under 35 U.S.C. 154(b) by 6 days.

(21) Appl. No.: 09/632,043

(22) Filed: Aug. 3, 2000

(51) Int. Cl.[7] ..... B60R 21/00
(52) U.S. Cl. ..... 297/464
(58) Field of Search ..... 24/685 B, 171; 297/464, 468, 469, 463.1, 463.2

(56) References Cited

U.S. PATENT DOCUMENTS 3,818,548 A * 6/1974 Meyerson
4,848,794 A * 7/1989 Mader et al.
4,946,198 A * 8/1990 Pittore et al.
5,000,481 A * 3/1991 Willson
5,005,910 A * 4/1991 Itkis et al.
5,186,520 A * 2/1993 Whitaker et al.
5,328,249 A * 7/1994 Ball
D365,691 S * 1/1996 Sedlack et al.
5,579,561 A * 12/1996 Smith et al.
5,681,094 A * 10/1997 Brown et al.

* cited by examiner

*Primary Examiner*—Milton Nelson, Jr.
(74) *Attorney, Agent, or Firm*—John D. Gugliotta

(57) ABSTRACT

A seat belt restraint lock for children is disclosed, comprised of an improved female receptacle for a motor vehicle seat belt buckle. The female receptacle consists of a main body, of a generally rectangular, box configuration. A plate located on the top surface of the main body covers the traditional release button. The plate can only be opened by compressing two locking cylinders located on the lateral sides of the main body. The locking cylinders possess spring tension to ensure that a child cannot open the plate.

8 Claims, 4 Drawing Sheets

SEAT BELT RESTRAINT LOCK FOR CHILDREN

RELATED APPLICATIONS AND DISCLOSURES

The present invention was first disclosed in the Disclosure Document filed on Jun. 8, 1998. There have been no previously filed, nor any co-pending applications, anywhere in the world.

BACKGROUND OF THE INVENTION

1. Field of the Invention

The present invention relates generally to seat belt restraint devices, and, more particularly, to a seat belt restraint lock for children.

2. Description of the Related Art

Child safety is among the most important issues that concern today's parents. These concerns are heightened in the area of automobile safety. When children reach the age/size where the use of a child safety seat is unavailable, parents resort to seat belts to protect their children's lives.

However, as many parents know, children at that age are prone to play with the buckles that secure the seat belt, creating a dangerous situation should the buckle become released. As a result, parents must monitor their children, which creates the additional risk of taking their eyes off the road.

Accordingly, the need has arisen for a means by which the child is denied access to the release mechanism.

In the related art, several devices are disclosed that describe various tamper-resistant seat belt assemblies for child safety seats. These include U.S. Pat. No. 5,681,094, issued in the name of Brown et. al., U.S. Pat. No. 5,579,561, issued in the name of Smith et. al., U.S. Pat. No. 5,328,249, issued in the name of Ball and U.S. Pat. No. 5,005,910, issued in the name of Itkis et. al.

U.S. Pat. No. 5,000,481, issued in the name of Willson, describes a seat belt locking device to secure a child's safety seat to a conventional shoulder/lap belt restraint system.

U.S. Pat. No. 4,946,198, issued in the name of Pittone et. al., discloses a vehicle safety strap specifically designed for children.

U.S. Pat. No. D. 365,691, issued in the name of Sedlack, describes a child's booster car seat adaptable to vehicle shoulder/lap belts.

A search of the prior art did not disclose any patents that anticipate directly many features of the instant invention. Consequently, a need has been felt for providing an apparatus and method which overcomes the problems cited above.

SUMMARY OF THE INVENTION

It is therefore an object of the present invention to provide an improved seat belt restraint lock for children which denies a child access to the release mechanism, while simultaneously allowing parents to quickly and easily buckle the child into the seat belt and remove the child from the seat belt.

Briefly described according to one embodiment of the present invention, a seat belt restraint lock for children is disclosed, comprised of an improved female receptacle for a motor vehicle seat belt buckle. The female receptacle consists of a main body, of a generally rectangular, box configuration. A plate located on the top surface of the main body covers the traditional release button. The plate can only be opened by compressing two locking cylinders located on the lateral sides of the main body. The locking cylinders possess spring tension to ensure that a child cannot open the present invention.

It is another object of the present invention to provide a device that prevents seat belt tampering by a child, thus ensuring the child's safety and allowing the driver to focus his or her attention on driving.

It is another object of the present invention to provide a device that easily installs over an existing seat belt buckle and can be easily removed by adults.

Other objects of the present invention include providing a device that is lightweight, sturdy and cost effective to produce.

| DESCRIPTIVE KEY | |
|---|---|
| 10 | seat belt restraint lock for children |
| 20 | female receptacle |
| 25 | seat belt |
| 30 | main body |
| 40 | seat belt connection means |
| 50 | receiving orifice |
| 60 | male protrusion |
| 70 | plate |
| 80 | spring loaded hinge mechanism |
| 90 | securement protrusion |
| 100 | hole |
| 110 | locking assembly |
| 120 | locking assembly housing |
| 130 | locking cylinder |
| 140 | release groove |
| 150 | spring |
| 160 | locking cylinder hole |
| 170 | locking cylinder securement means |
| 180 | standard locking means |
| 190 | standard release button |
| 200 | main body securement means |
| 210 | electrical door locking system |
| 220 | electrical switch |
| 230 | armature |
| 240 | alarm |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 7.

1. Detailed Description of the Figures

Figure 1:
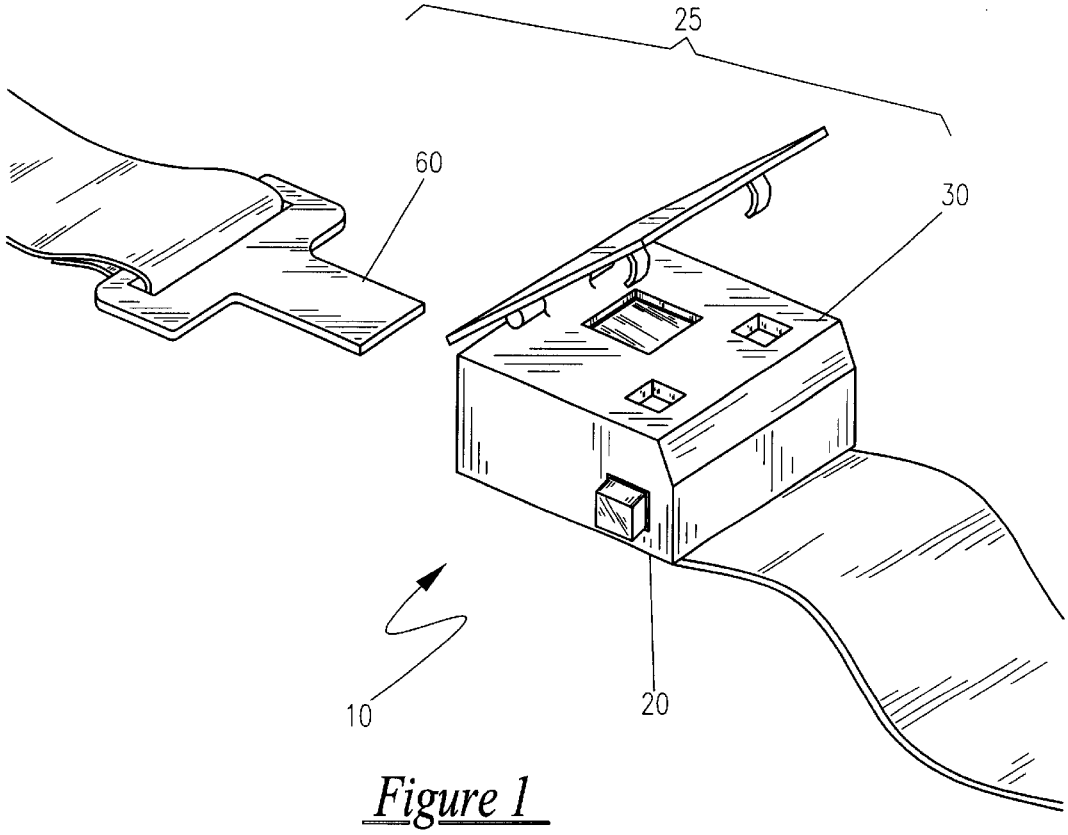
FIG. 1 is a perspective view of the preferred embodiment of seat belt restraint lock for children, shown in-use with a child 10.

Referring now to FIG. 1, a seat belt restraint lock for children 10 is shown, according to the present invention, comprises a new improved female receptacle 20 for a seat belt 25 buckle. The female receptacle 20 consists of a main body 30, of a generally rectangular, box configuration. The posterior end of the main body 30 connects to a seat belt 25 via a seat belt connection means 40.

Figure 2:
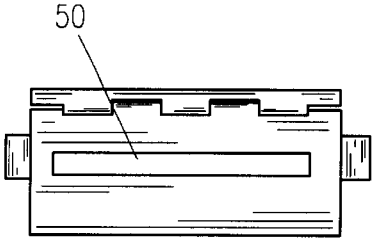
FIG. 2 is an anterior view thereof.

Referring now to FIGS. 1 and 2, a receiving orifice 50 is located on the anterior end of the main body 30 and is formed from the main body 30. The receiving orifice 50 is configured to accept a standard male protrusion 60 of a standard seat belt 25.

Figure 3:
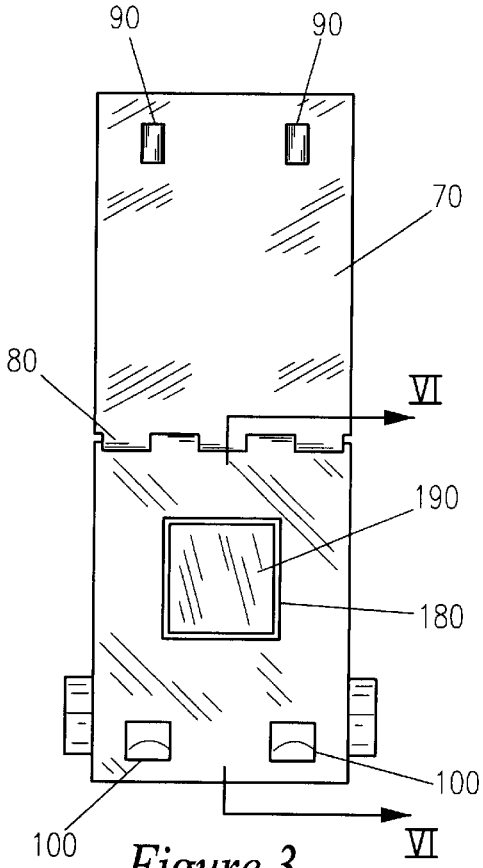
FIG. 3 is a top view thereof.

Referring now to FIG. 3, a plate 70, of a generally flat, rectangular configuration, is secured to the anterior, top surface of the main body 30 so as to cover the top surface of the main body 30 when in the resting position. Securement is achieved via a spring loaded hinge mechanism 80.

Figure 4:
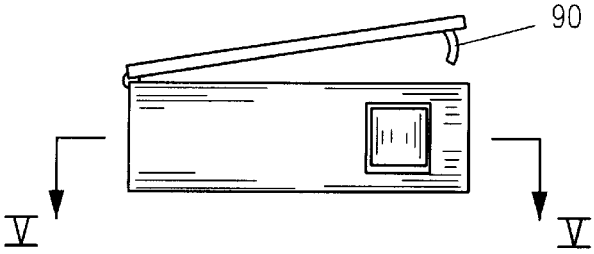
FIG. 4 is a right side view thereof.

Referring now to FIGS. 3 and 4, a plurality of securement protrusions 90 are positioned on the bottom, posterior surface portion of the plate 70, and are of a hook type configuration. For purposes of disclosure, two securement protrusions 90 are depicted as L-shaped hooks.

Two holes 100 are located on the top surface of the main body 30, positioned and configured to allow the securement protrusions 90 to pass therethrough when the plate 70 is in the closed position, resting against the top surface of the main body 30.

Figure 5:
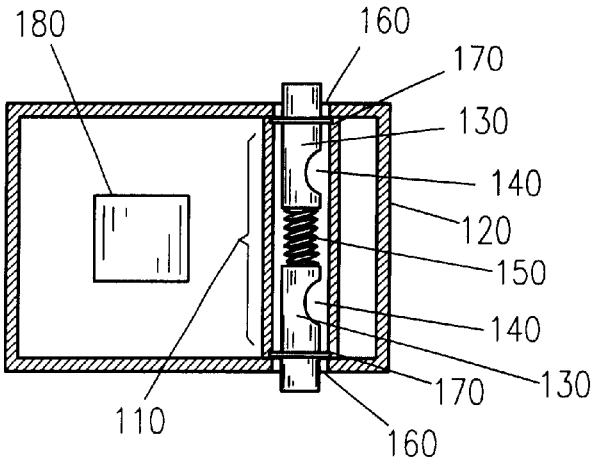
FIG. 5 is a cross sectional view thereof, cut along line V—V of FIG. 4.

Referring now to FIG. 5, a locking assembly 110 is located inside the main body 30, at the posterior portion of the main body 30. The locking assembly 110 is positioned in a locking assembly housing 120, of a generally cylindrical configuration, extending perpendicular to the elongated centerline of the main body 30.

The locking assembly 110 consists of two locking cylinders 130, each of a generally linearly elongated, cylindrical configuration. The locking cylinders 130 have a cross sectional diameter which permits each securement protrusion to releasably engage around the locking cylinder 130, thereby keeping the plate 70 in the closed position against the top surface of the main body 30. The securement protrusions 90 are configured to attach around locking cylinders 130.

Figure 6:
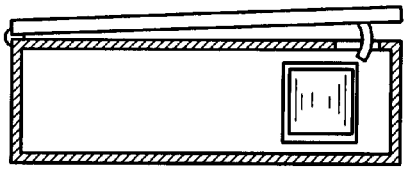
FIG. 6 is a cross sectional view of the preferred embodiment, cut along line VI—VI of FIG. 3.
Figure 7:
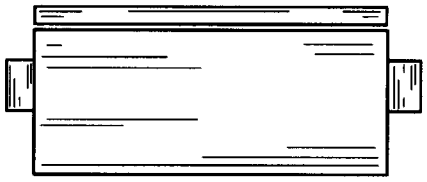
FIG. 7 is a posterior view of the preferred embodiment of the present invention.

Referring now to FIGS. 5 and 6, a release groove 140 is located on the external circumferential surface of each locking cylinder 130, and positioned so that the release groove 140 is positioned toward the posterior of the main body 30. The release grooves 140 are positioned on the locking cylinder 130 so as to be located between each securement protrusion 90 and the lateral sides of the main body 30, when the securement protrusions 90 are secured to each locking cylinder 130. With this configuration, lateral, inward compression of each locking cylinder 130 brings the release grooves 140 into linear alignment with their respective securement protrusions 90, thereby releasing the securement protrusions 90 from their respective locking cylinders 130, thereby releasing the plate 70 from the main body 30.

A spring 150 is located between the two locking cylinders 130, and provides resistance to lateral compression of the two locking cylinders 130 together. The spring 150 produces a resistance force larger than that required to open a traditional seat belt 25.

Referring now to FIGS. 1, 5, 6 and 7, the outside lateral ends of each locking cylinder 130 extend beyond the main body 30, through locking cylinder holes 160 formed by and located on the lateral sides of the main body 30. Locking cylinder securement means 170, attached to the locking cylinders 130, and positioned inside the main body 30, keep the locking cylinders 130 from exiting the main body 30 through the locking cylinder holes 160.

Referring now to FIG. 1, a standard locking means 180 is located inside the main body 30 to hold the male protrusion 60 of the seat belt 25. A standard release button 190, as found on the female receptacle 20 of a traditional seat belt 25, is position inset, inside the main body 30 and holds the traditional male protrusion 60 inside the main body 30.

Figure 8:
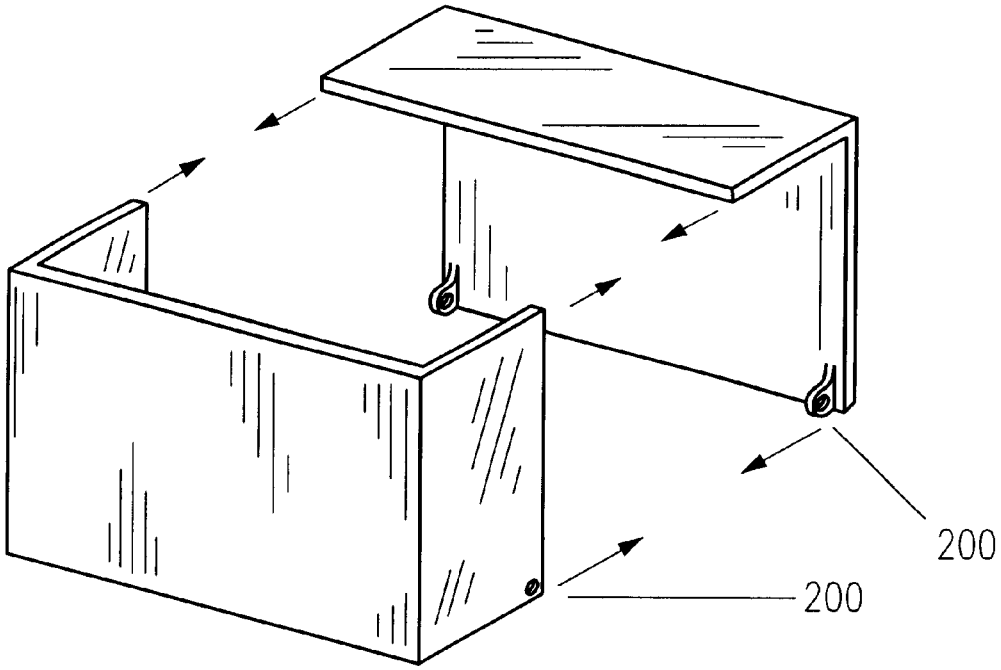
FIG. 8 is a perspective view of an alternate embodiment of the present invention.

Referring now to FIG. 8, in an alternate embodiment of the present invention, the main body 30 is configured in two pieces, to be attached over an existing, traditional female receptacle 20 of a seat belt 25 as a retrofit, thus limiting access to the standard release button 190 of the standard female receptacle 20. Main body 30 securement means 200, such as screws, are used to hold the main body 30 together.

Figure 9:
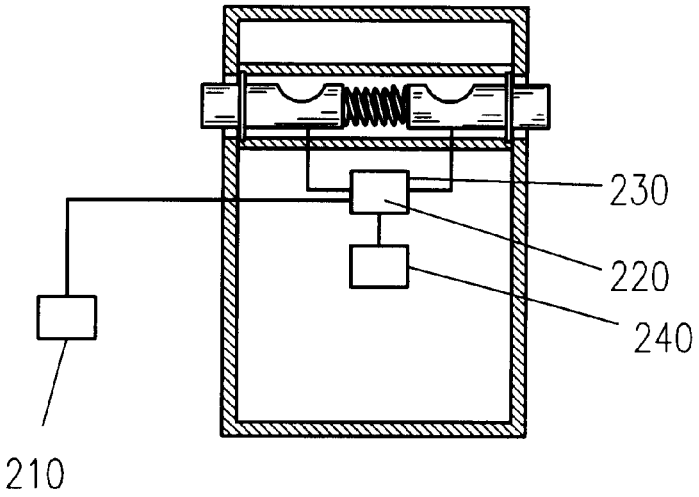
FIG. 9 is a top view of another alternate embodiment of the present invention, with the plate and the top surface of the main body removed.

Referring now to FIG. 9, in another embodiment of the present invention, the present invention has an additional feature. The present invention is connected to the electrical door locking system 210 of the motor vehicle, such that when a door is unlocked from the main switch on a front seat door panel only, the plate 70 is released from the main body 30, thereby granting access to the standard release button 190. Inside the main body 30, an electric switch 220 is connected to two armatures 230 which are connected to their respective locking cylinder 130.

When the door is unlocked, the electrical signal activates the electrical switch 220, which moves the armatures 230, which moves the locking cylinders 130 inward, thereby releasing the securement protrusions 90.

It is also envisioned that an alarm is attached to the present invention, either inside the main body 30 or attached to the main body 30, so that if the plate 70 is opened while the motor vehicle door is still locked, an audible alarm 240 is sounded. The present invention can also be manually operated as discussed above.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the present invention, the child is placed in the car seat and the seat belt 25 is properly adjusted. The male protrusion 60 is placed in the receiving orifice 50 in the main body 30 of the female receptacle 20. The plate 70 is then closed down, locking the securement protrusions 90 through the holes 100 on the main body 30 upper surface, and locking around each locking cylinder 130.

To open the present invention and remove the child from the car seat, the parent compresses each locking cylinder 130, thereby releasing the plate 70, which springs open. The standard release button 190 can then be pressed and the male protrusion 60 removed from the main body 30 of the female receptacle 20. The child can then be removed from the car seat.

The foregoing description is included to illustrate the operation of the preferred embodiment and is not meant to limit the scope of the invention. The scope of the invention is to be limited only by the following claims.

What is claimed is:

1. A seat belt restraint lock for children comprising:

a main body of a generally rectangular, box configuration, with a posterior end which connects to a seat belt via a seat belt connection means;

a receiving orifice, said receiving orifice located on the anterior end of said main body and is formed from said main body;

a standard locking means, said standard locking means located inside said main body and used to secure a traditional seat belt male protrusion to said main body;

a standard release button, as found on a female receptacle of a traditional seat belt, said standard release button positioned inset, inside said main body;

a plate, of a generally flat, rectangular configuration, said plate secured to the anterior, top surface of said main body so as to cover the top surface of said main body when in a resting position;

a spring loaded hinge mechanism, said spring loaded hinge mechanism used to connect said plate to said main body;

a plurality of securement protrusions, of a hook type configuration, said securement protrusions positioned on the bottom, posterior surface portion of said plate;

two holes, said holes located on the top surface of said main body, positioned and configured to allow said securement protrusions to pass therethrough when said plate is in a closed, position, resting against said top surface of said main body;

a locking assembly, said locking assembly located inside said main body, at the posterior portion of said main body, and used to limit access to said standard release button located on the top surface of said main body; and a locking assembly housing, of a generally cylindrical configuration; said locking assembly housing used to hold said locking assembly.

2. The seat belt restraint lock for children described in claim 1, wherein two securement protrusions are used to secure said plate to said main body.

3. The seat belt restraint lock for children described in claim 1, wherein the locking assembly further comprises:

two locking cylinders, each of a generally linearly elongated, cylindrical configuration;

two release groove, one said release groove located on the external circumferential surface of each locking cylinder, and positioned so that said release groove is positioned toward the posterior of said main body;

a spring, said spring located between said two locking cylinders, and provides resistance to compression of said two locking cylinders together;

locking cylinder holes, said locking cylinder holes formed by and located on the lateral sides of said main body; and locking cylinder securement means, said locking cylinder securement means attached to said locking cylinders, and positioned inside said main body, keeping said locking cylinders from exiting said main body through said locking cylinder holes.

4. The seat belt restraint lock for children of claim 3, wherein said spring produces a resistance force larger than that required to open a traditional seat belt.

5. The seat belt restraint lock for children described in claim 1, wherein said main body is of a two piece configuration, designed to be attached over an existing, traditional female receptacle of a seat belt as a retrofit, thus limiting access to said standard release button of said traditional female receptacle.

6. The seat belt restraint lock for children described in claim 1, wherein said main body is in electrical communication with an electrical door locking system of a motor vehicle, such that when a door is unlocked from a main switch on a front seat door panel only, said plate is released from said main body, thereby granting access to said standard release button.

7. The seat belt restraint lock for children described in claim 6, wherein inside said main body, an electric switch is connected to two armatures which each are connected to a locking cylinder, respectively, so that when the door is unlocked, an electrical signal activates said electrical switch moves said armatures, which moves said locking cylinders inward, thereby releasing said securement protrusions.

8. The seat belt restraint lock for children described in claim 6, further comprising:

an alarm, said alarm located inside said main body so that if said plate is opened while the motor vehicle door is still locked, an audible alarm is sounded.

* * * * *